US008201928B2

(12) United States Patent
Gerner et al.

(10) Patent No.: US 8,201,928 B2
(45) Date of Patent: Jun. 19, 2012

(54) INKJET EJECTOR HAVING AN IMPROVED FILTER

(75) Inventors: Bradley J. Gerner, Penfield, NY (US); John R. Andrews, Fairport, NY (US); Bryan R. Dolan, Rochester, NY (US); Pinyen Lin, Rochester, NY (US); Antonio DeCrescentis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 365 days.

(21) Appl. No.: 12/638,553

(22) Filed: Dec. 15, 2009

(65) Prior Publication Data

US 2011/0141203 A1 Jun. 16, 2011

(51) Int. Cl.
*B41J 2/045* (2006.01)

(52) U.S. Cl. ..... 347/71

(58) Field of Classification Search ..... 347/71, 347/72, 70, 68, 69, 54; 310/311, 327
See application file for complete search history.

(56) References Cited

U.S. PATENT DOCUMENTS

| | | | |
|---|---|---|---|
| 4,539,568 | A | 9/1985 | Lewis et al. |
| 4,658,274 | A | 4/1987 | DeYoung |
| 5,227,013 | A | 7/1993 | Kumar |
| 5,236,551 | A | 8/1993 | Pan |
| 5,276,468 | A | 1/1994 | Deur et al. |
| 5,386,430 | A | 1/1995 | Yamagishi et al. |
| 5,523,543 | A | 6/1996 | Hunter, Jr. et al. |
| 5,628,926 | A | 5/1997 | Belgacem et al. |
| 5,657,065 | A | 8/1997 | Lin |
| 5,767,882 | A | 6/1998 | Kaplinsky et al. |
| 5,843,363 | A | 12/1998 | Mitwalsky et al. |
| 6,139,674 | A | 10/2000 | Markham et al. |
| 6,193,362 | B1 | 2/2001 | Nakata et al. |
| 6,199,980 | B1 | 3/2001 | Fisher et al. |
| 6,464,347 | B2 | 10/2002 | Kneezel et al. |
| 6,702,436 | B2 | 3/2004 | Haines et al. |
| 6,779,877 | B2 | 8/2004 | Andrews |
| 6,789,886 | B2 | 9/2004 | Andrews et al. |
| 6,817,708 | B2 | 11/2004 | Kneezel |
| 6,916,090 | B2 | 7/2005 | Valley et al. |
| 6,951,383 | B2 | 10/2005 | Giere et al. |
| 7,101,030 | B2 | 9/2006 | Clark et al. |
| 7,111,932 | B2 | 9/2006 | Steed et al. |
| 7,147,315 | B2 | 12/2006 | Keenan et al. |
| 7,172,271 | B2 | 2/2007 | Tominaga et al. |
| 7,264,333 | B2 | 9/2007 | Silverbrook |
| 7,264,343 | B2 | 9/2007 | Harvey et al. |
| 7,275,817 | B2 | 10/2007 | Clark et al. |

(Continued)

FOREIGN PATENT DOCUMENTS

JP 2002210988 * 7/2002

*Primary Examiner* — Kristal Feggins
(74) *Attorney, Agent, or Firm* — Maginot, Moore & Beck, LLP

(57) ABSTRACT

A manifold assembly has been constructed that filters ink before the ink enters an inkjet ejector in an inkjet print head. The manifold assembly includes an adhesive layer having openings, an ink manifold layer having a plurality of openings, the openings in the adhesive layer being aligned with the openings in the ink manifold layer, and a polymer layer having a plurality of filter areas, the filter areas being aligned with the openings in the ink manifold layer and the openings in the adhesive layer, the adhesive layer being interposed between the polymer layer and the ink manifold layer.

6 Claims, 6 Drawing Sheets

U.S. PATENT DOCUMENTS

| | | | | |
|---|---|---|---|---|
| 7,431,444 | B2 | 10/2008 | Ito | |
| 7,484,835 | B2 | 2/2009 | Kim et al. | |
| 2006/0001711 | A1 | 1/2006 | Buchanan et al. | |
| 2006/0139407 | A1* | 6/2006 | Umeda et al. | 347/54 |
| 2007/0012618 | A1 | 1/2007 | Swenson | |
| 2007/0195143 | A1 | 8/2007 | Andrews | |
| 2008/0122901 | A1 | 5/2008 | Platt et al. | |
| 2008/0122912 | A1 | 5/2008 | Platt et al. | |
| 2009/0029142 | A1 | 1/2009 | Jacobson | |
| 2010/0295901 | A1* | 11/2010 | Stephens et al. | 347/54 |

* cited by examiner

INKJET EJECTOR HAVING AN IMPROVED FILTER

TECHNICAL FIELD

This disclosure relates generally to micro-fluidic devices that eject fluid from a liquid supply in the device and, more particularly, to ink ejectors in print heads that eject ink onto imaging substrates.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper.

FIGS. 5A and 5B illustrate one example of a single inkjet 10 that is suitable for use in an inkjet array of a print head. The inkjet 10 has a body 22 that is coupled to an ink manifold 12 through which ink is delivered to multiple inkjet bodies. The body also includes an ink drop-forming orifice or nozzle 14. In general, the inkjet print head preferably includes an array of closely spaced nozzles 14 that eject drops of ink onto an image receiving member (not shown), such as a sheet of paper or an intermediate member.

Ink flows from manifold 12 through a port 16, an inlet 18, a pressure chamber opening 20 into the body 22, which is sometimes called an ink pressure chamber. Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

A firing signal is applied across metal film layers 34 to excite the piezoelectric transducer 32, which causes the transducer to bend. Because the transducer is rigidly secured to the diaphragm 30, the diaphragm 30 deforms to urge ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

Typically, the layers of inkjet 10 are laminated metal plates or sheets. These sheets may be stainless steel, for example, that are chemically etched to form the structures and cavities in the plates that are then stacked to form the inkjet stack. Referring once again to FIGS. 4A and 4B, these sheets or plates include a diaphragm plate 40, an inkjet body plate 42, an inlet plate 46, an aperture brace plate 54, and an aperture plate 56. The piezoelectric-transducer 32 is bonded to diaphragm 30, which is a region of the diaphragm plate 40 that overlies ink pressure chamber 22.

Ink that flows through a print head may contain solid debris. This debris may be small enough to enter a manifold within a print head, but large enough to clog an inlet, an outlet, or an aperture. To address this issue, filter layers may be included in an inkjet ejector stack. These filters may be included in a channel layer to filter ink flowing into an inkjet ejector through an inlet. Typically, these filters are fabricated from stainless steel, nickel electroformed screens, woven mesh screens, or polyimide layers. The pores are required to be smaller in diameter than the final aperture through which the fluid passes so they block the passage of contaminants large enough to block the final aperture. Ancillary structure may also be provided to redirect fluid flow to another portion of the filter in the event that a portion of the filter becomes clogged.

A known goal of print head design is to increase the number of inkjet ejectors per unit of distance in a print head. As the number of inkjet ejectors per unit of distance increases, the size of the inkjet ejectors is reduced. Consequently, the fluid passageways in the inkjet ejectors become smaller and clean ink flowing in those passageways becomes increasingly important. Therefore, effective filtering of the ink continues to be an important factor in print head design.

SUMMARY

A manifold assembly has been constructed that filters ink before the ink enters an inkjet ejector in an inkjet print head. The manifold assembly includes an adhesive layer having openings, an ink manifold layer having a plurality of openings, the openings in the adhesive layer being aligned with the openings in the ink manifold layer, and a polymer layer having a plurality of filter areas, the filter areas being aligned with the openings in the ink manifold layer and the openings in the adhesive layer, the adhesive layer being interposed between the polymer layer and the ink manifold layer.

A method for assembling an inkjet print head with a filter that filters ink before the ink flows into an inkjet ejector has been developed. The method includes aligning openings in an adhesive layer to openings in an ink manifold layer, tacking the adhesive layer to the ink manifold layer, aligning filter areas in a polymer layer with the openings in the ink manifold layer and the openings in the adhesive layer, the adhesive layer being interposed between the polymer layer and the ink manifold layer, and bonding the polymer layer to the ink manifold layer.

The manifold assembly may be used to construct an inkjet print head having a filter positioned external to the inkjet ejectors in the print head. The inkjet print head includes an inkjet body layer having a plurality of pressure chambers, a flexible diaphragm plate bonded to the inkjet body layer to form a wall of each pressure chamber, the flexible diaphragm plate including a plurality of openings, each opening in the flexible diaphragm plate fluidly communicating with one pressure chamber in the inkjet body layer, a plurality of piezoelectric transducers, the piezoelectric transducers being attached to the diaphragm plate, an adhesive layer having a plurality of openings, an ink manifold layer having a plurality of openings, the openings in the adhesive layer being aligned with the openings in the ink manifold layer, and a polymer layer having a plurality of filter areas, the filter areas in the polymer layer being aligned with the openings in the ink manifold layer and the openings in the adhesive layer and each opening in the flexible diaphragm layer fluidly communicating with only one opening in the ink manifold layer to enable a filtered ink to flow from the ink manifold layer to a pressure chamber in the inkjet body layer.

BRIEF DESCRIPTION OF THE DRAWINGS

The foregoing aspects and other features of an improved filter layer and how the improved filter layer facilitates micro-fluidic device assembly are explained in the following description, taken in connection with the accompanying drawings.

DETAILED DESCRIPTION

Figure 1A:
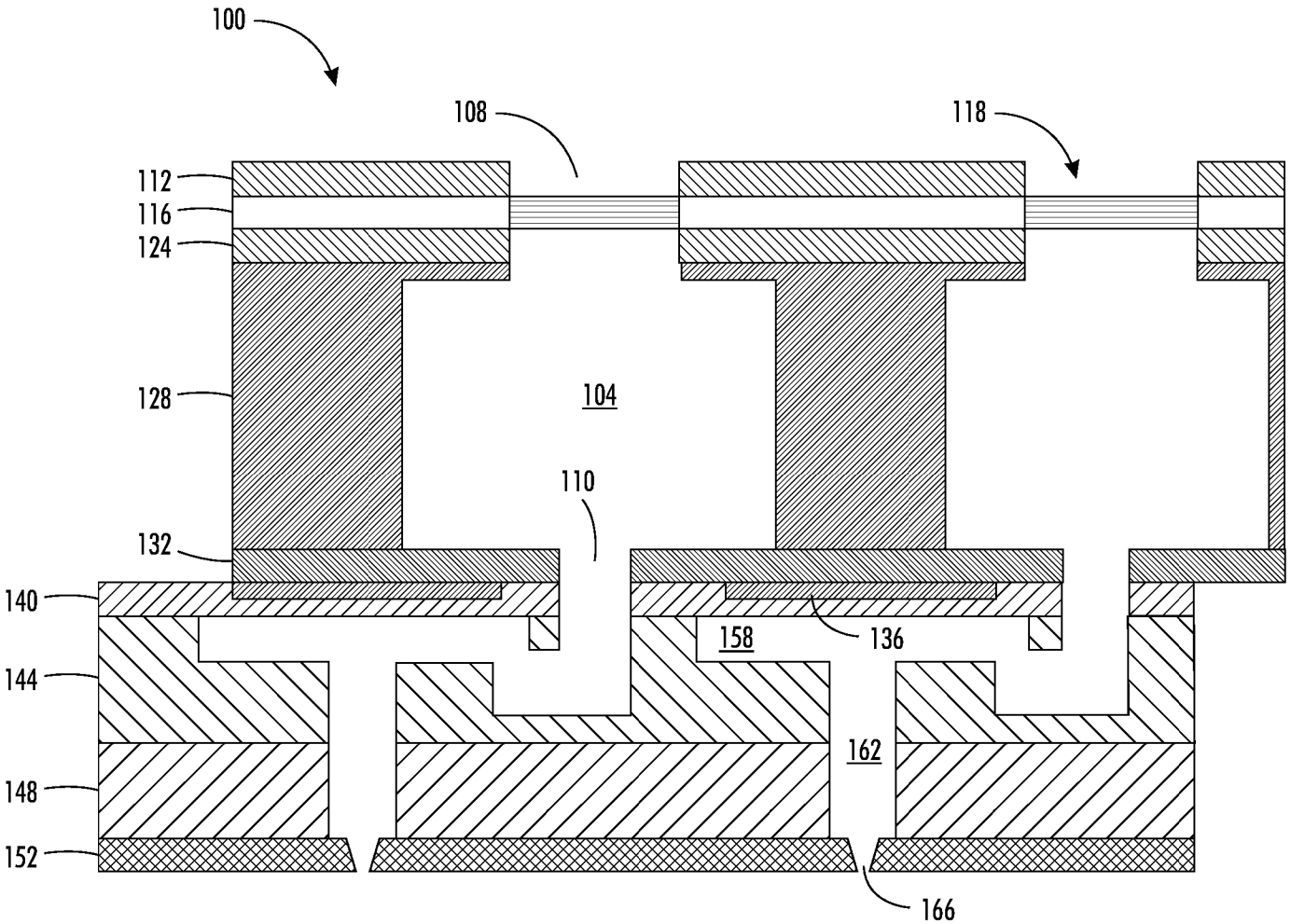
FIG. 1A is a schematic side cross-sectional view of an inkjet stack that is coupled to an ink source through a polymer filter positioned at the inlet opening of an ink manifold.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, etc. In the description below, reference is made in the text and the drawings to an ink jet stack; however, the discussion is applicable to other micro-fluidic devices that dispense liquid or pump fluid. Therefore, the description should not be read to limit the application of the method to ink jet stacks alone.

Figure 1B:
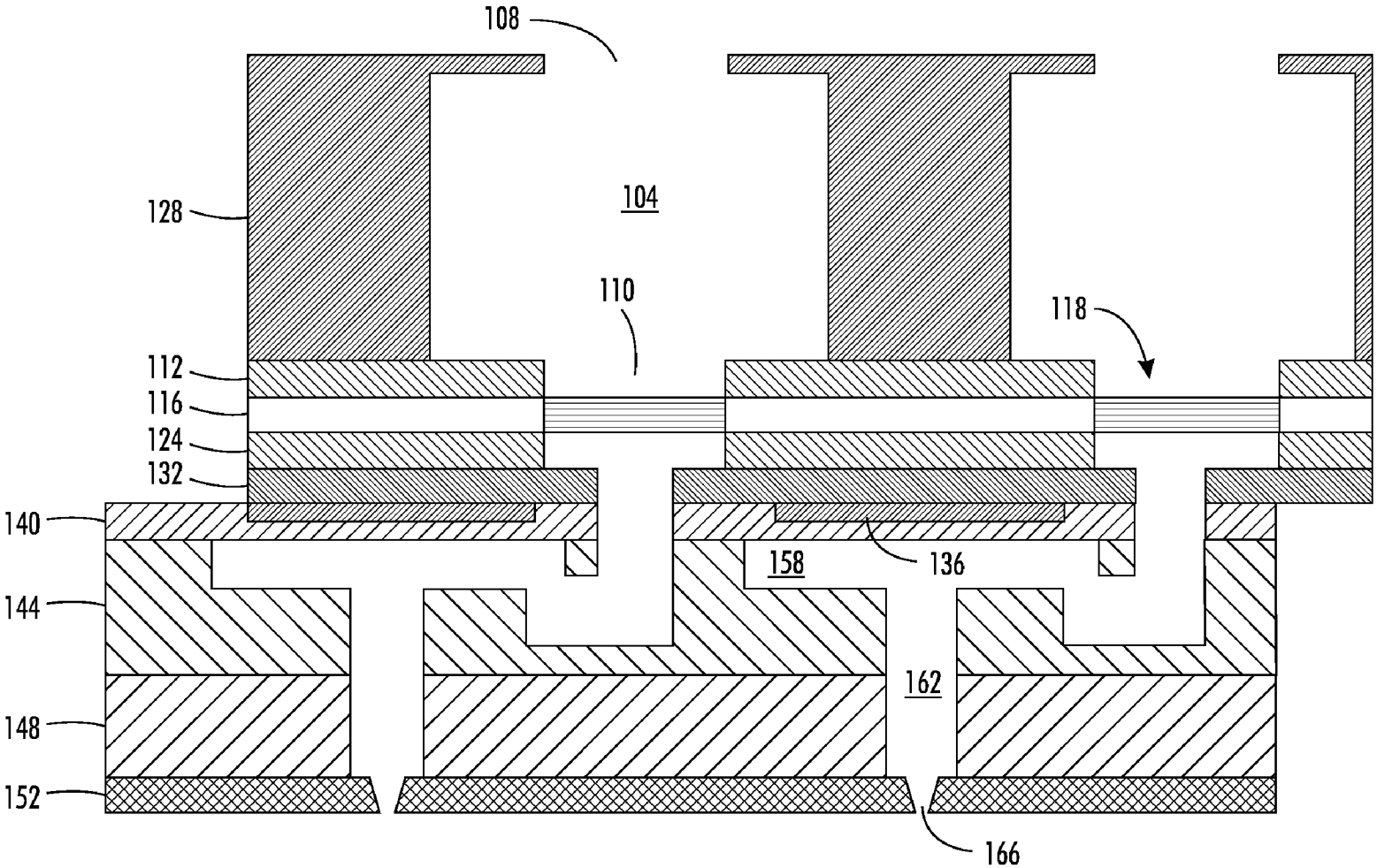
FIG. 1B is a schematic side cross-sectional view of another embodiment of an inkjet stack that is coupled to an ink source through a polymer filter at the outlet opening of an ink manifold.

FIG. 1A and FIG. 1B depict two embodiments of an inkjet stack that positions in the polymer filter external to the inkjet stack but in different locations. Both FIG. 1A and FIG. 1B show an inkjet stack assembly 100 that is attached to an external manifold 128. The manifold 128 forms one or more chambers 104 that store ink before the ink flows into a pressure chamber 158 via the manifold outlet 110. The pressure chamber 158 holds ink until a piezoelectric transducer 136 has an electric current applied, causing it to bend a flexible diaphragm 140 in the direction of the pressure chamber. The diaphragm 140 is attached to the bottom of the piezoelectric transducer 136, and in the orientation of FIG. 1 the piezoelectric transducer's bottom faces towards the pressure chamber 158. The diaphragm 140 forms a wall of the pressure chamber, and when it bends in response to the deformation of the piezoelectric transducer, the ink in the pressure chamber is urged into an outlet channel 162 before leaving the inkjet stack as a droplet via aperture 166. The body chamber 158 is formed within a body layer 144, typically by etching a channel in the body layer. The body layer 144 is placed above an outlet layer 148, which has outlet channels 162 formed within in. In one typical embodiment, the body layer 144 and outlet layer 148 are metal sheets that may be brazed together. The outlet layer 148 is placed above an aperture plate 152. In typical embodiments, the aperture plate may be formed from metal or a polymer, and the apertures 166 formed in the aperture plate 152 are aligned with the outlet channels 162 in the outlet layer 148.

Referring specifically to FIG. 1A, this embodiment shows a manifold layer 128 that receives ink through an inlet 108 for temporary storage in the manifold chamber 104. This ink may contain solid debris that could potentially clog the inkjet ejector formed in the inkjet stack. In FIG. 1A, a polymer layer 116 is placed across inlet 108 adhering to the manifold layer 128 via an adhesive layer 124. The polymer layer 116 has one or more areas with filter pores formed through its surface 118. The material of polymer layer 116 may be a polyimide or thermoset polymer. In this embodiment, a top adhesive layer 112 is placed on polymer layer 116, while a bottom adhesive layer 124 is disposed between polymer layer 116 and the manifold layer 128. Suitable film adhesive layers include double sided adhesive tapes having thermoset or thermoplastic adhesive layers on opposite sides of a thermoset or thermoplastic polymer core. In yet further alternatives the adhesive could be a dispensed or transfer film of liquid adhesive. Alternatively, the adhesive layers can be a thermoplastic or thermoset adhesive. The polymer layer 116 is aligned with the manifold so that the regions containing the pores 118 align with the manifold inlet 108. This positioning filters solid debris, preventing them from entering the manifold chamber 104, which is bonded to an electrical circuit board 132 that is part of the inkjet stack.

Referring to FIG. 1B, the same polymer layer 116 with regions containing pores 118 is present, but in this embodiment the polymer layer 116 is placed over the manifold outlet 110. In this embodiment, the top adhesive layer 112 is disposed between polymer layer 116 and the manifold 128, while the bottom adhesive layer 124 is disposed between polymer layer 116 and the electrical circuit board 132. This position prevents solid debris from traveling from the manifold chamber 104 to the pressure chamber 158, outlet chamber 162, and aperture 166. The embodiments shown in FIGS. 1A and 1B are not exhaustive, and the filter may be placed within the manifold in different configurations to filter the ink effectively before the ink flows through the manifold outlet 110.

Figure 2A:
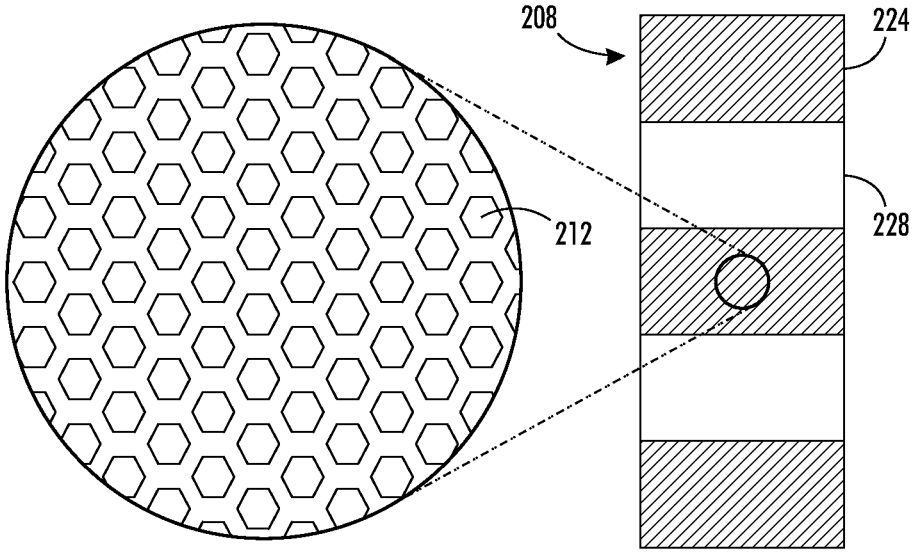
FIG. 2A is a magnified view of a possible pore configuration for a polymer filter used in the inkjet stack of FIG. 1A and FIG. 1B.
Figure 2B:
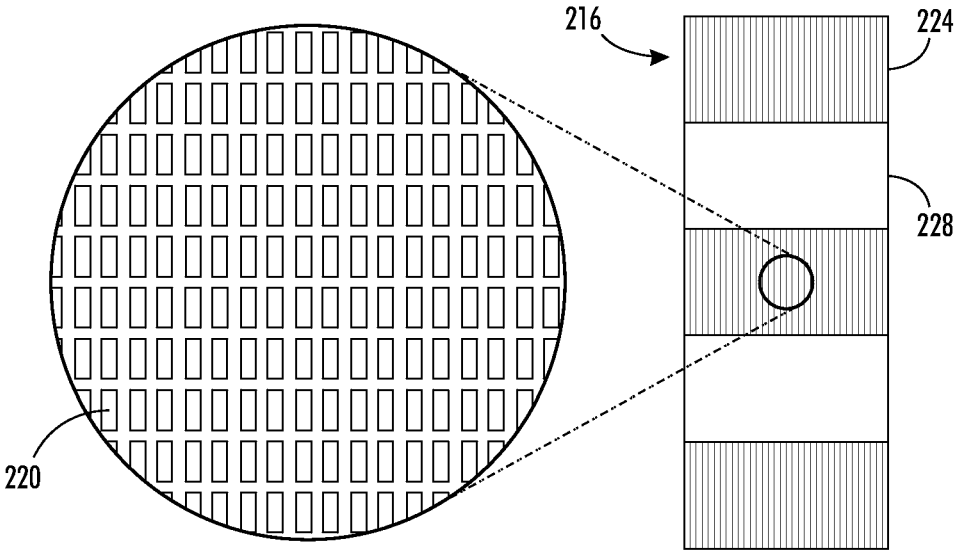
FIG. 2B is a magnified view of an alternative pore configuration for a polymer filter used in the inkjet stack of FIG. 1A and FIG. 1B.

FIG. 2 contains magnified views 200 of two possible pore configurations for polymer layers 208 that may be used with the print heads of FIG. 1A and FIG. 1B. Each of the polymer layers 208 is composed of a polymer film, and many polymers may be used as films including thermoplastic polyimide, polyester, polysulfone, polyetheretherketone, polyphenelyene sulfide, and polyethersulfone. The polymer layers have continuous regions 228, and regions with pores formed through the polymer layer 224. The pore regions 224 may act as filters to allow a fluid such as ink to flow through the pores while also blocking solid debris from passing therethrough. FIG. 2A has a view 204 of a combination of hexagonal ablated pores 212. In FIG. 2B another filter 216 has an array of rectangular ablated pores 220. While many pore sizes are possible, pores with a diameter of 20-40 microns are used in one embodiment of the filter for a solid ink or gel ink printing system. Additionally, many arrangements for the spacing of the pores are possible, but a filter configuration should include a sufficient number of pores to enable an unimpeded flow of ink to continue if one or more pores are blocked by solid debris. As the variations above indicate, many shapes and configurations of pores are envisioned for use with these polymer filters, and the examples presented herein should not be seen as being exhaustive.

Figure 3:
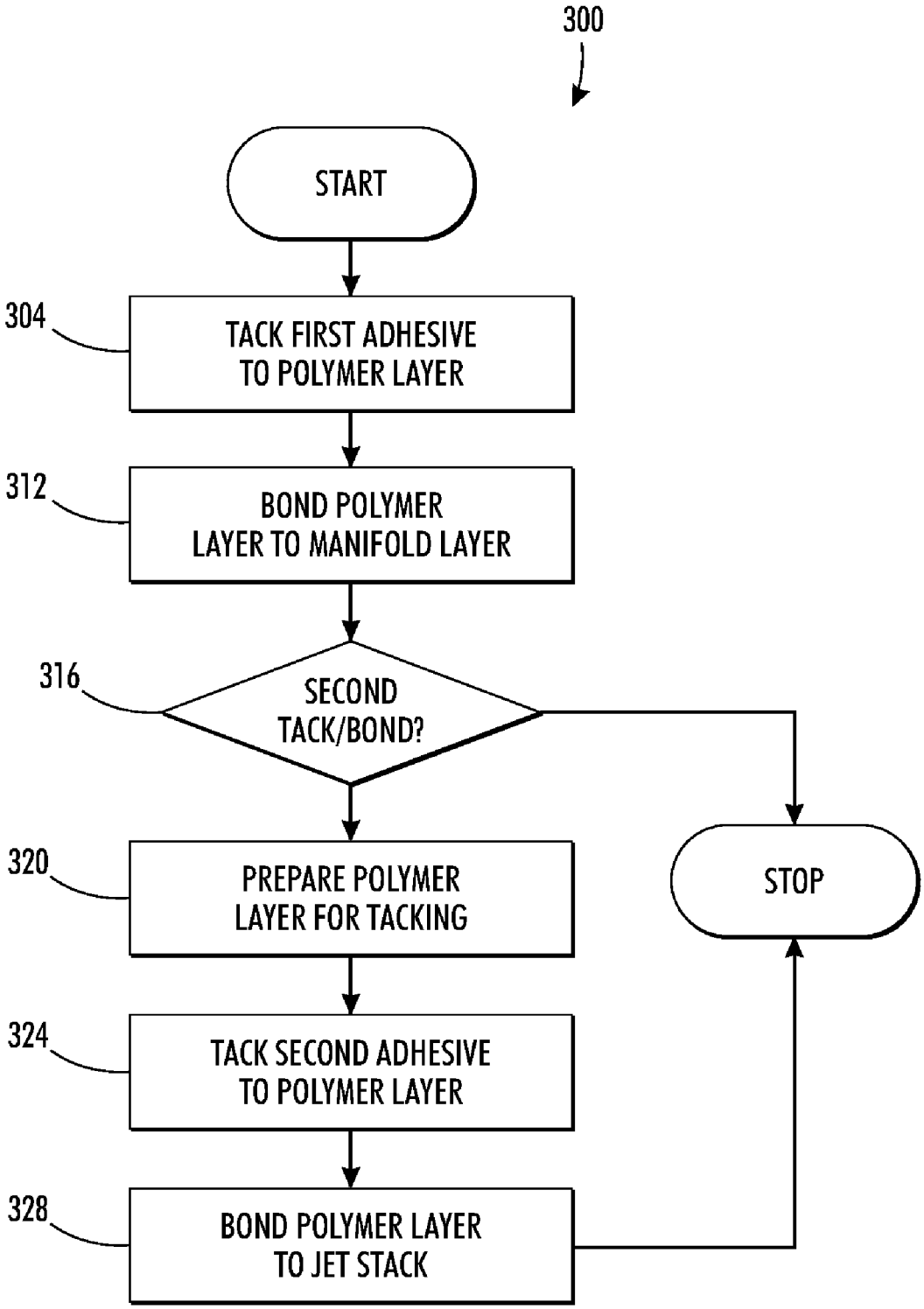
FIG. 3 is a flow diagram of the process used to bond one surface of a polymer layer to a manifold layer, and optionally to bond another surface of the polymer layer to an inkjet stack.

A process 300 for bonding a polymer layer such as the polymer layer 116 of FIG. 1 to a manifold layer and optionally to an inkjet stack is depicted in FIG. 3. The process 300 begins by tacking an adhesive layer with the polymer layer (block 304).

Figure 4:
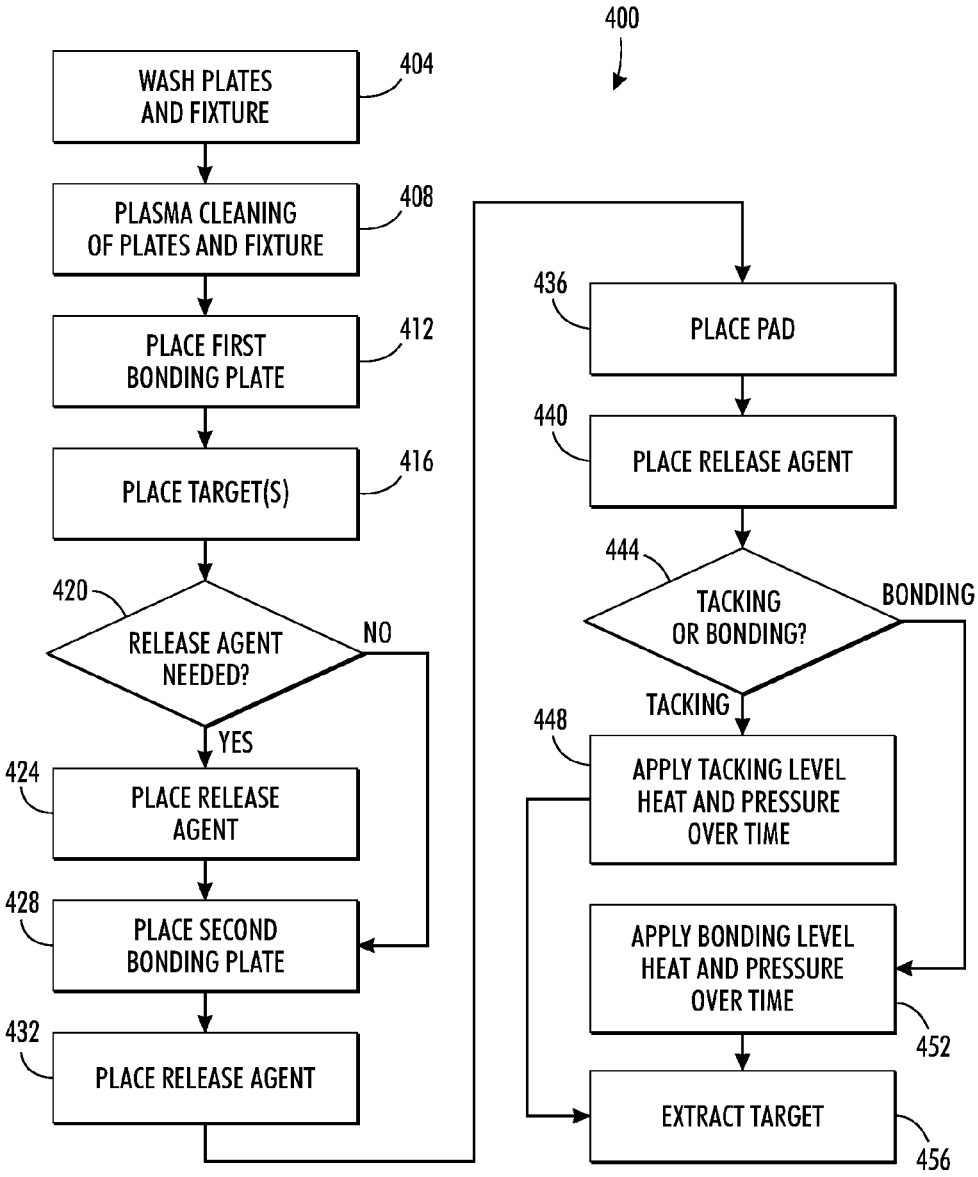
FIG. 4 is a flow diagram of tacking and bonding processes used to tack or bond two or more material layers together.
Figure 5A:
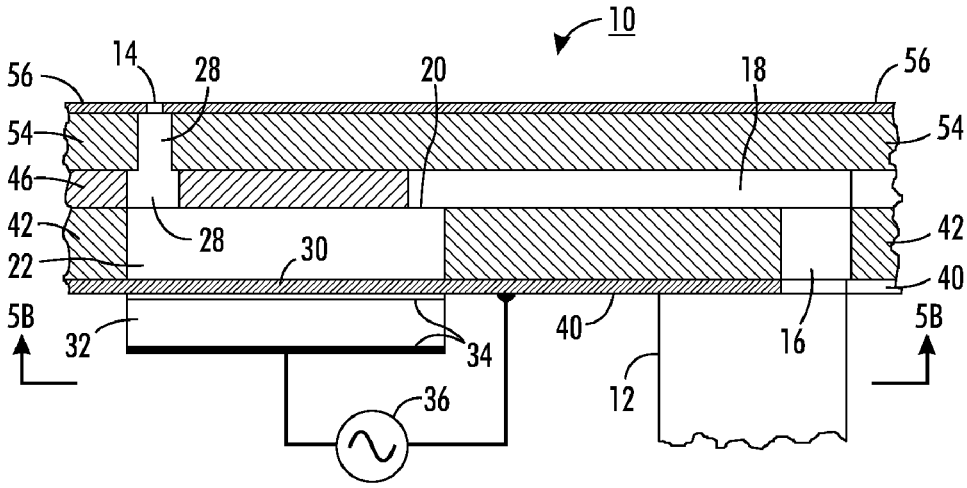
FIG. 5A PRIOR ART
FIG. 5A is a schematic side-cross-sectional view of a prior art embodiment of an inkjet.
Figure 5B:
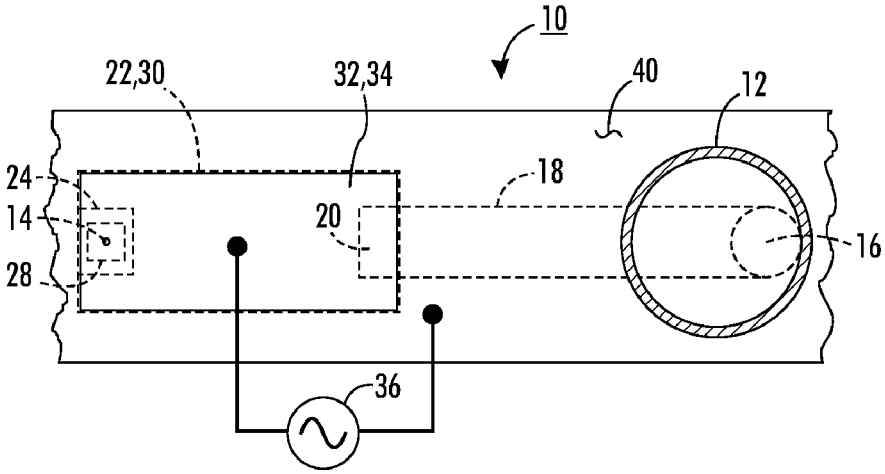
FIG. 5B PRIOR ART
FIG. 5B is a schematic to view of the prior art embodiment of the inkjet of FIG. 5A.

The adhesive layer and polymer layer are tacked together in order to maintain the alignment of the adhesive during the bonding process (block 304). A flow diagram that describes an example of a process 400 for tacking the polymer layer and adhesive material is depicted in FIG. 4. The tacking process begins by cleaning a fixture, two bonding plates, and the outlet plate in a detergent spray wash and ultrasonic wash cycle to clean larger contaminants from their surfaces (block 404). The fixture and two bonding plates are then exposed to a plasma cleaner to remove thin-film contamination and leave their surfaces exposed (block 408). The first bonding plate is then aligned and placed above the fixture (block 412). The fixture is a superstructure providing a base with a plurality of pins extending vertically from the base. The pins are arranged to align with tooling holes formed through various layers used in the tacking process. The first bonding plate is placed on the fixture with the fixture pins extending through tooling holes formed through the first bonding plate. The first bonding plate preferably has a uniformly flat surface except for the tooling holes and is preferably made from a metal such as stainless steel.

The tacking process continues by placing the target layers above the first bonding plate (block 416). In this instance, the target layers are the polymer layer and the adhesive material. The polymer layer is placed above the first bonding plate with a release agent coating on the polymer layer facing the first bonding plate. The release agent coating may be a fluoropolymer material and the release agent prevents the polymer layer from adhering to the first bonding plate during the tacking process. The polymer layer has tooling holes that accept the fixture pins and align the polymer layer with the first bonding plate. The adhesive is then placed above the polymer. The adhesive layer has a series of openings that are aligned to expose the regions of the polymer layer that serve as a filter, while covering regions of the polymer layer that will be bonded to other components. The adhesive material is temporarily held in position using thermal tape capable of withstanding the temperatures of the tacking process. The thermal tape is applied to the edge of the adhesive, leaving the surface of the adhesive above the polymer layer exposed.

Because the adhesive should not adhere to the bonding plates used in the tacking and bonding processes, a release agent covers the exposed surface of the adhesive material (block 420). The release agent is applied above the adhesive, typically as a thin sheet of a fluoropolymer, such as polytetrafluoroethylene (block 424). The release agent prevents the adhesive from tacking to a second bonding plate, which is placed above the adhesive and polymer layer in alignment with the fixture pins (block 428). The second bonding plate may be identical in form to the first bonding plate and provides a uniform upper surface for the tacking process. Another layer of release agent, preferably a thin polyimide film, such as Upilex (formed from biphenyl tetracarboxylic dianhydride monomers), is applied above the second bonding plate (block 432). A pad is placed over the release agent coating of the second bonding plate (block 436). The pad allows for an even transfer of pressure to the target layers during the tacking process. In the embodiment of FIG. 4, this pad is made of a flexible material capable of withstanding the pressure and temperature of the tacking process, such as silicone rubber, and is 6.35 mm thick. A layer of the same release agent coating the second bonding plate is applied over the upper surface of the pad (block 440).

The assembly formed in blocks 412-440 is placed in a heated pressure chamber in order to tack the polymer layer to the adhesive (block 444). Pressure is applied vertically through the pad, second bonding plate, polymer layer, adhesive, first bonding plate, and the fixture. The combination of heat and pressure causes the adhesive to tack to the polymer layer. In the example embodiment of FIG. 4, the tacking is complete after 3 minutes of exposure to a temperature of 250° C. at a pressure of 150 psi (block 448). The polymer layer with tacked adhesive is extracted from the fixture assembly (block 452). The release agent coatings on the exposed surfaces of the polymer layer and adhesive material allow the bonding plates to be removed without distorting the polymer layer and adhesive. The thermal tape used in the tacking process may be removed as the tacked adhesive material remains aligned with the polymer layer. The layer of release agent between the second bonding plate and the pad allows the pad to be removed as well. The fixture, bonding plates, and pad may be reused in another tacking process.

Returning to FIG. 3, the polymer layer with the tacked adhesive layer is bonded to the manifold layer (block 312). This process is carried out in a similar manner to the tacking process of block 304, as again depicted in FIG. 4. The process begins with the fixture and bonding plates being washed (block 404) and plasma cleaned (block 408) in the same manner described above in order to remove contaminants. The fixture, bonding plates, and pad used for the tacking process may also be used in the bonding process.

The bonding process of FIG. 4 continues with the first bonding plate being aligned and placed above the fixture with the fixture pins passing through tooling holes formed in the first bonding plate surface (block 412). The target is then placed above the first bonding pad (block 416). In this case, the target is the polymer layer with tacked adhesive and the manifold layer. The polymer layer is placed with the thin coating of release agent facing the first bonding plate, with the fixture pins extending through tooling holes in the polymer layer, and with the tacked adhesive layer exposed. The manifold is aligned in position above the adhesive layer, with the exposed regions of the polymer layer corresponding to either the inlet or outlet openings of the manifold as shown in FIG. 1A and FIG. 1B. Because the adhesive is meant to bond to the manifold layer, no release agent is applied to the adhesive's surface (block 420). The second bonding plate is placed above the manifold layer with the fixture pins passing through tooling holes formed in the second bonding plate surface (block 428). As with the tacking process, a thin layer of release agent is applied to the second bonding plate (block 432), a pad is placed above the second bonding plate (block 436), and a thin layer of release agent is applied to pad's upper surface (block 440).

The assembly formed in blocks 412-440 is placed in a heated pressure chamber in order to bond the polymer layer to the adhesive (block 444). Pressure is applied vertically through the pad, second bonding plate, polymer layer, manifold layer, first bonding plate, and the fixture. The combination of heat and pressure causes the adhesive to bond the polymer layer and manifold layer together. In the example embodiment of FIG. 4, the bonding is complete after 30 minutes of exposure to a temperature of 350° C. at a pressure of 350 psi (block 448). The bonded polymer layer and manifold are extracted from the fixture assembly (block 452). The bonding process hermetically seals the polymer layer to the manifold layer. The release agent coating on the exposed surfaces of the polymer layer allows the bonding plates to be removed without distorting the polymer layer. The layer of release agent between the second bonding plate and the pad enables the pad to be removed as well. The fixture, bonding plates, and pad may be reused in another bonding process.

The process 300 of FIG. 3 may continue in embodiments where a second adhesive tacking and bonding process is necessary (block 316). If the embodiment does not require the polymer layer to be bonded on both sides, the process of FIG. 3 is completed, but in embodiments that do require the polymer layer to be bonded on both sides, the process continues by preparing the polymer layer for a second tacking process (block 320).

The polymer layer is prepared for a second tacking process in block 324 by removing the layer of release agent coating the polymer's exposed surface. This release agent allows the polymer layer to be exposed to pressure and heat from the bonding plates, but could interfere with tacking the second adhesive layer. The prepared polymer layer is tacked to a second adhesive layer (block 324). The process used for tacking the second polymer layer also uses the steps of FIG. 4 and is similar to the tacking process of block 304 described above.

The manifold layer and polymer layer with tacked adhesive may now be bonded to the rest of the inkjet stack (block 328). This bonding process is similar to the bonding process used for bonding the polymer layer to the manifold layer, and the second adhesive layer is typically aligned in the same manner as the first adhesive layer, to align openings in the adhesive layer with areas of the polymer layer that are exposed to filter ink (block 312). In binding the polymer layer to the inkjet stack, the polymer layer is aligned with ink inlets in the jet stack so that the areas with filtered openings allow ink to flow from the manifold, through the filtered area of the polymer layer, and into the body chamber in the inkjet stack. In the example embodiment of FIG. 3, the second adhesive layer bonds to an electronic circuit board in the inkjet stack.

The processes disclosed in FIG. 3 and FIG. 4 are merely illustrative of possible embodiments for tacking and bonding the polymer layer, adhesive, manifold, and optionally inkjet stack, and alternative processes are envisioned. A possible alternative process could tack and bond the adhesive material to the manifold layer before tacking and bonding to the polymer layer. In another alternative process, the polymer layer may be formed from a thermoset compound or another form of polymer that is self-adhering. These materials may adhere directly to a manifold layer or the inkjet stack, and this allows for the process of FIG. 3 to begin at block 312 by bonding the polymer layer directly to the manifold. Similarly, a self-adhering polymer compound could bond directly to the inkjet stack without the adhesive tacking step of block 324. These alternatives only require a bonding process, and not a tacking process. Some examples of adhesives that do not require a tack step are dispensed liquid adhesives or transfer film adhesives. Active optomechanical alignment of the adhesives and plates can be done in one of or all of the alignment steps rather than the tooling pin and slot alignment described above.

Once a filter has been positioned within an inkjet stack as described above, the filter is positioned in a flow of ink that eventually supplies ink to an inlet channel of an inkjet ejector in an inkjet stack. Construction of the filter from polymer material reduces the cost of filter fabrication when the filter is included within the inkjet stack. Specifically, previously known filters positioned within the inkjet stack are formed with metal plates that are brazed with gold. As the filter openings constitute a significant surface area that is brazed with gold, such filters are relatively expensive. Additionally, positioning the filter outside the inkjet stack enables the filter to remove debris from the ink flow at a location that reduces the number of filters required for a print head. That is, when a filter is placed within the inkjet stack, a filter is required for each inkjet ejector in a print head. When the filter is positioned at the inlet to or within a manifold, the filtered ink may be supplied to two or more inkjet stacks coupled to the manifold for ink. Not only does such positioning of the filter help render the construction of a print head more economical, it also aids in the design of an inkjet stack ejector that can be operated at a higher frequency than previously known.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet print head comprising:

an inkjet body layer having a plurality of pressure chambers;

a flexible diaphragm plate bonded to the inkjet body layer to form a wall of each pressure chamber, the flexible diaphragm plate including a plurality of openings, each opening in the flexible diaphragm plate fluidly communicating with one pressure chamber in the inkjet body layer;

a plurality of piezoelectric transducers, the piezoelectric transducers being attached to the diaphragm plate;

an adhesive layer having a plurality of openings;

an ink manifold layer having a plurality of openings, the openings in the adhesive layer being aligned with the openings in the ink manifold layer; and a polymer layer having a plurality of filter areas, the filter areas in the polymer layer being aligned with the openings in the ink manifold layer and the openings in the adhesive layer and each opening in the flexible diaphragm layer fluidly communicating with only one opening in the ink manifold layer to enable a filtered ink to flow from the ink manifold layer to a pressure chamber in the inkjet body layer.

2. The inkjet ejector of claim 1 wherein the polymer layer is interposed between the flexible diaphragm layer and the ink manifold layer.

3. The inkjet ejector of claim 1 wherein the ink manifold layer is interposed between the flexible diaphragm layer and the polymer layer.

4. The inkjet ejector of claim 1, the filter areas further comprising:

a plurality of pores have a size in a range from about 20 microns to about 40 microns.

5. The inkjet ejector of claim 1 wherein the polymer layer is a polyimide layer.

6. The inkjet ejector of claim 1 further comprising:

an electrical circuit board interposed between the polymer layer and the flexible diaphragm layer.

* * * * *